US006712296B1

(12) United States Patent
Hlousek et al.

(10) Patent No.: US 6,712,296 B1
(45) Date of Patent: Mar. 30, 2004

(54) FUEL INJECTION VALVE FOR INTERNAL COMBUSTION ENGINES

(75) Inventors: Jaroslaw Hlousek, Golling (AT); Heinrich Werger, Golling (AT); Otto Hagenauer, Oberalm (AT)

(73) Assignee: Robert Bosch GmbH, Stuttgart (DE)

( * ) Notice: Subject to any disclaimer, the term of this patent is extended or adjusted under 35 U.S.C. 154(b) by 397 days.

(21) Appl. No.: 09/857,292

(22) PCT Filed: Sep. 20, 2000

(86) PCT No.: PCT/DE00/03269

§ 371 (c)(1),
(2), (4) Date: Dec. 26, 2001

(87) PCT Pub. No.: WO01/25622

PCT Pub. Date: Apr. 12, 2001

(30) Foreign Application Priority Data

Oct. 1, 1999 (DE) ..... 199 47 194

(51) Int. Cl.[7] ..... F02M 59/00; F02M 39/00; F02M 47/02; B05B 1/30

(52) U.S. Cl. ..... 239/533.3; 239/533.2; 239/88; 239/585.5; 239/533.9

(58) Field of Search ..... 239/88, 89, 90, 239/91, 96, 533.2, 533.3, 533.9, 533.8, 585.1, 585.3, 585.4, 585.5; 251/129.15, 129.21, 127

(56) References Cited

U.S. PATENT DOCUMENTS 4,784,102 A * 11/1988 Igashira et al. ..... 123/447
4,875,658 A * 10/1989 Asai ..... 251/129.21
5,176,115 A * 1/1993 Campion ..... 123/179.17
5,868,317 A * 2/1999 English ..... 239/88
6,029,628 A * 2/2000 Oleksiewicz et al. ..... 123/446

* cited by examiner

*Primary Examiner*—Davis Hwu
(74) *Attorney, Agent, or Firm*—Ronald E. Greigg

(57) ABSTRACT

A fuel injection valve for internal combustion engines, having a pistonlike valve member, axially movable counter to the closing force of a spring, in the bore of a valve body and that controls at least one injection opening. A control chamber surrounding the valve member is disposed between a guided portion of the valve member and an oil leakage chamber that receives the spring; the valve member communicates with an inlet conduit via a throttling annular gap and with the oil leakage chamber via a control bore. In the closing motion of the valve member away from the valve seat, fuel is positively displaced out of the control chamber into the oil leakage chamber by a pressure face. In a portion of the valve member stroke, the control chamber is closed, except for a throttle gap formed between a cylindrical portion and the control bore, toward the oil leakage chamber, and the fuel pressure in the control chamber rises, since the outflow can now take place only via the throttle gap. As a result, the seating of the valve sealing face on the valve seat is damped, leading to reduced running noise of the engine and reduced wear in the region of the valve sealing face.

30 Claims, 4 Drawing Sheets

FUEL INJECTION VALVE FOR INTERNAL COMBUSTION ENGINES

CROSS-REFERENCE TO RELATED APPLICATIONS

This application is a 35 U.S.C. 371 application of PCT/DE 00/03269 filed on Sep. 20, 2000.

BACKGROUND OF THE INVENTION

1. Field of the Invention

The invention is directed to a fuel injection valve and particularly to such a valve for internal combustion engines.

2. Description of the Prior Art

One known fuel injection valve, known from German Published, Nonexamined Patent Application DE 195 08 636 A1, employs a pistonlike valve member disposed in the bore of the valve body and is axially movable counter to the closing force of a spring. On its end toward the combustion chamber, the valve member has a valve sealing face, which cooperates with a valve seat embodied in the valve body, and as a result at least one injection opening is controlled. The inward- or outward-oriented opening stroke motion of the valve member is defined by a stroke stop. In the closing motion of the valve member away from the stroke stop, the valve member is accelerated in the direction toward the valve seat by the force of the spring. The fuel, which is located between the valve sealing face and the valve seat, has to be expelled in the process. Although this fuel does provide a certain damping of the impact of the valve member on the valve seat, nevertheless the force on the valve member upon impact with the valve seat is still so great that relatively loud engine noise results. Furthermore, in long-term operation, wear can occur in the region of the valve seat, along with incomplete sealing of the injection openings from the combustion chamber.

SUMMARY OF THE INVENTION

The fuel injection valve of the invention for internal combustion engines has the advantage over the prior art that the seating of the valve member on the valve seat in the closing motion is additionally damped. Between the portion of the valve member guided in the bore and the oil leakage chamber, a control chamber is provided, which surrounds the valve member over its entire circumference. By means of a pressure face embodied on the valve member, upon the closing motion of the valve member, fuel is expelled from the control chamber through the control bore into the oil leakage chamber, which takes place unthrottled at the onset of the closing motion. In a partial stroke of the valve member, a cylindrical portion of the valve member plunges into the control bore, thus forming an annular throttle gap between the control bore and the cylindrical part of the valve member, through which throttle gap the fuel can now flow out of the control chamber only in throttled fashion. As a result, the seating of the valve member on the valve seat is damped, and the maximum impact forces are reduced. The noise caused by the closure of the valve member is thus lessened, leading to quieter engine operation. Furthermore, the damping leads to reduced wear of the valve sealing face and the valve seat.

Another advantage of the invention is that it can be employed in both fuel injection valves that open inward, away from the combustion chamber, and in fuel injection valves that open outward. All that is needed is to transpose the disposition of the control piston and the control bore.

The outflow of fuel from the control chamber need not take place exclusively via the annular throttle gap. In a further version, it can also be provided that additional throttling conduits are embodied in the valve body or in the valve member that connect the control chamber to the oil leakage chamber. This also makes it possible for the throttling action of the control chamber to be regulatable via adjustable throttle connections.

In both versions, the spring loading the valve member is disposed in the oil leakage chamber, which has an outflow conduit through which the fuel is carried back into the tank via an outflow line. The outflow rate of the fuel from the control chamber depends not only the flow resistance of the throttle connection to the oil leakage chamber but also on the pressure difference between the oil leakage chamber and the pressure chamber. If the pressure of the fuel in the oil leakage chamber is relatively high, then the outflow of fuel from the control chamber will proceed more slowly than at low pressure. As a result, a higher pressure can build up in the control chamber, which via the higher pressure on the pressure face damps the seating motion of the valve member more markedly. By the provision of a pressure holding valve in the outflow conduit of the oil leakage chamber or in the outflow line, a previously determined pressure can be maintained in the oil leakage chamber. The outflow rate from the control chamber and thus the damping action of the control chamber can thus be varied by way of the holding pressure. If the pressure holding valve is embodied in regulatable form, then the damping action can be adapted to given requirements as a function of the engine operating state.

BRIEF DESCRIPTION OF THE DRAWINGS

Further advantages and features of the invention will be apparent from the description contained herein below, taken with the drawings, in which.

DESCRIPTION OF THE PREFERRED EMBODIMENT

Figure 1:
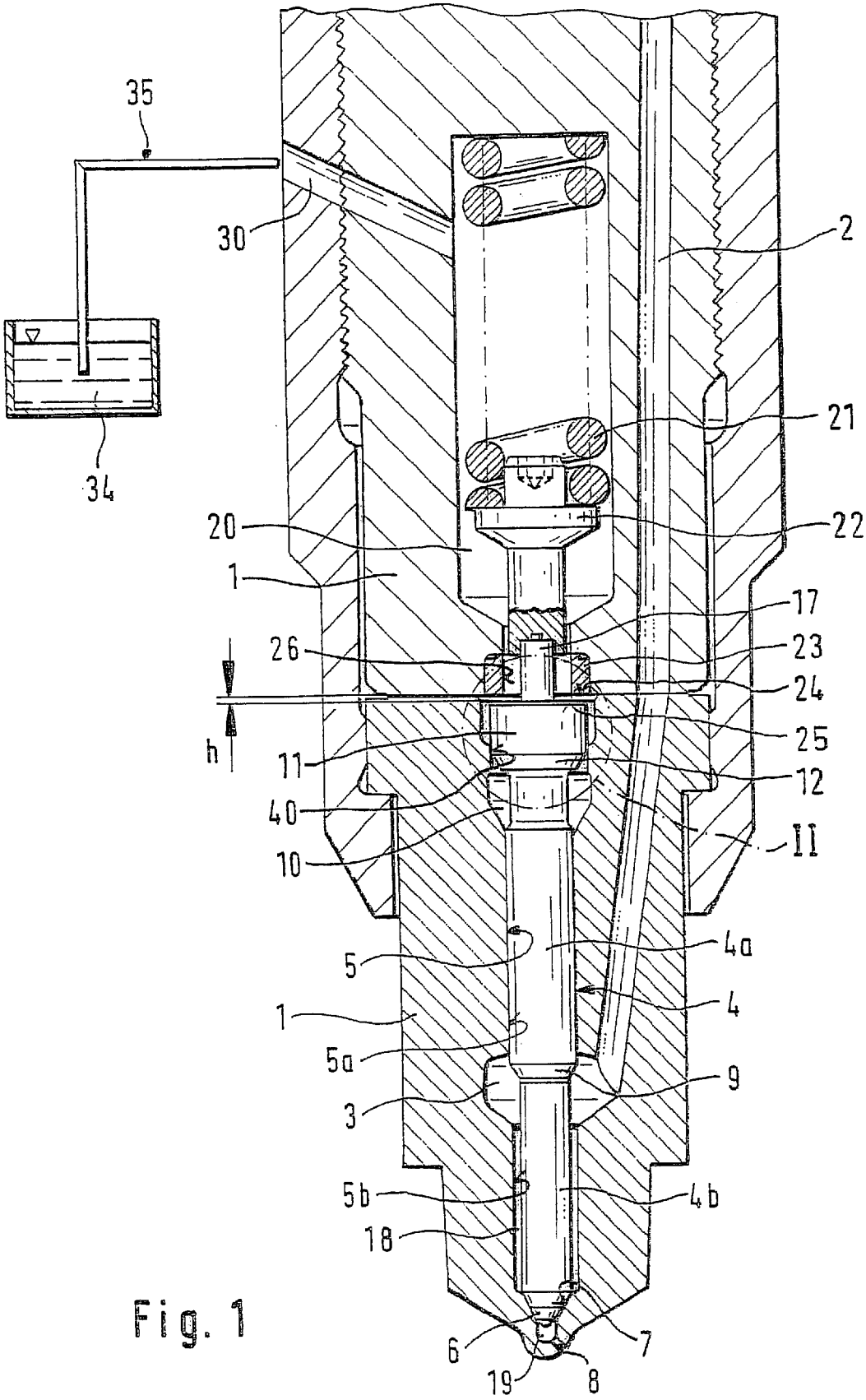
FIG. 1 is a longitudinal section through the first exemplary embodiment of an inward-opening fuel injection valve.

Referring to the drawings, in detail, a fuel injection valve of the invention for internal combustion engines is shown in longitudinal section in FIG. 1, and first the construction will be described, then the mode of operation of the fuel injection valve will be explained.

A valve body 1, which can be constructed in multiple parts, is disposed in a receiving bore of the housing of an internal combustion engine, not shown in the drawing; the upper end, remote from the combustion chamber, of the valve body 1 is fixed in the receiving bore, while the lower end, toward the combustion chamber, protrudes into the combustion chamber of the engine. A bore 5 is embodied in the valve body 1 and is subdivided into an upper portion 5*a* and a lower portion 5*b*. The bore 5 ends, on its end toward the combustion chamber, inside the valve body 1, and the part of the valve body 1 that closes the bore 5 toward the combustion chamber is embodied as an essentially conical valve seat 7. The valve seat 7 is adjoined toward the combustion chamber by a blind bore 19, in which at least one injection opening 8 is disposed that connects the blind bore 19 to the combustion chamber. Disposed in the bore 5 is a pistonlike, axially movable valve member 4, which on its end toward the combustion chamber has a substantially conical valve sealing face 6, which cooperates with the valve seat 7 embodied in the valve body. The valve member 4 is embodied with a graduated diameter, which subdivides it into an upper portion 4*a* and a lower portion 4*b*. The valve member 4 is guided in the bore 5 by its upper portion 4*a*. The lower portion 4*b* of the valve member 4 is embodied with a smaller diameter than the upper portion 4*a*, so that a pressure face 9 is formed at the transition between the two portions 4*a*, 4*b*. Between the wall of the bore 5 and the lower portion 4*b* of the valve member 4, an annular conduit 18 is formed, which in the region of the pressure face 9 forms a pressure chamber 3 by means of a radial widening in cross section. An inlet conduit 2 extending within the valve body 1 discharges into the pressure chamber 3 and can be made to communicate on its other end, via a high-pressure inlet line, not shown in the drawing, with a high-pressure fuel pump or some other high-pressure source. The inlet conduit 2 communicates with the valve seat 7 via the pressure chamber 3 and the annular conduit 18. In the inward-oriented opening stroke motion of the valve member 4, the valve sealing face 6 opens the communication from the annular conduit 18 to the blind bore 19, effecting communication of the inlet conduit 2 with the injection opening 8.

The upper portion 4*a* of the valve member 4 is adjoined by a substantially cylindrical, larger-diameter control piston 11, and as a result a pressure face 12 is disposed at the transition from the valve member 4 to the control piston 11. In the region of the upper portion 4*a* of the valve member 4, a control chamber 10 is formed by means of a radial cross-sectional widening of the bore 5. The jacket face of the control piston 11, on the end of the jacket face toward the combustion chamber, has a damping edge 13, which cooperates with a control edge that is embodied by a portion of the bore 5 embodied as a control bore 40. The control piston 11 is adjoined by an intermediate pin 17, disposed coaxially to the valve member 4 in an intermediate bore 26, and the intermediate pin is connected in turn to a spring plate 22 that protrudes into an oil leakage chamber 20 embodied on the end of the valve body 1 remote from the combustion chamber. Via this intermediate bore 26, the upper portion 5*a* of the bore 5 communicates with the oil leakage chamber 20, which in turn communicates with an outflow system 35 via an outflow conduit 30 embodied in the valve body 1. Between the spring plate 22 and the end of the oil leakage chamber 20 remote from the combustion chamber, a spring 21 is disposed with initial tension; it presses the valve member 4 with the valve sealing face 6 against the valve seat 7, via the spring plate 22, the intermediate pin 17, and the control piston 11.

The intermediate pin 17 is embodied with a smaller diameter than the control piston 11, and thus a stop shoulder 24 is formed at the transition from the control piston 11 to the intermediate pin 17. At the transition from the bore 5 to the intermediate bore 26, a stop ring 23 is disposed coaxially to the axis of the valve member 4. The stop ring 23 is fixed in the intermediate bore 26, and the side of the stop ring 23 toward the combustion chamber is embodied as a stroke stop 25; the axial spacing of the stroke stop 25 from the stop shoulder 24 in the closed state of the fuel injection valve defines the opening stroke h of the valve member 4. The overlap s of the damping edge 13 and the control edge 14 in the closing position of the valve member 4 is always dimensioned such that it is less than the opening stroke h of the valve member 4. Preferably, the overlap s amounts to from 10–50% of the opening stroke h.

Figure 2:
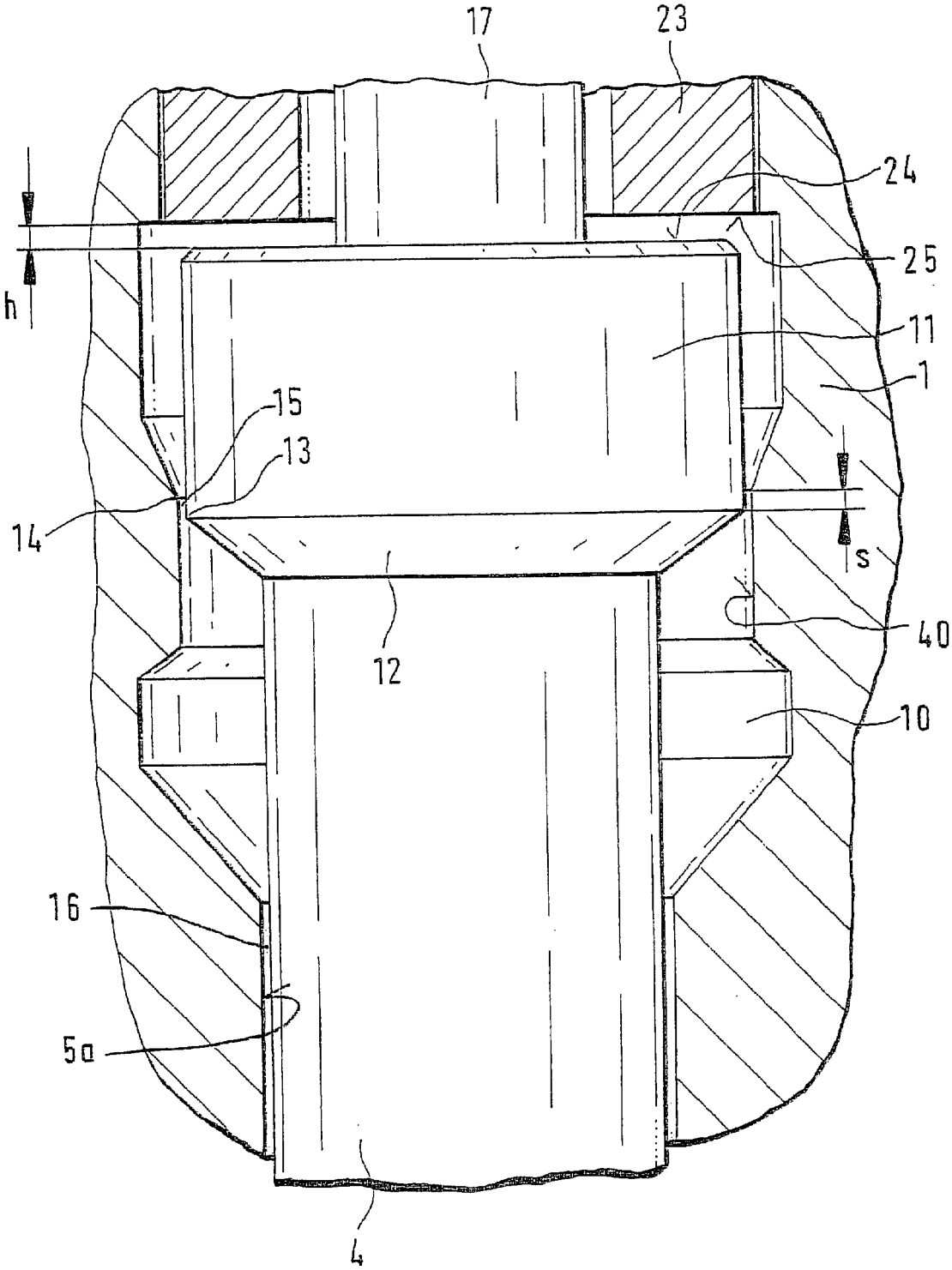
FIG. 2 is an enlargement of FIG. 1 in the region of the control chamber.

In FIG. 2, the region of the control chamber 11 of the fuel injection valve is shown again, enlarged. In the closed state of the fuel injection valve, the damping edge 13 and the control edge 14 overlap, so that the control chamber 10 communicates with the oil leakage chamber 20 only via an annular throttle gap 15. The second opening of the control chamber 10 is defined via the throttling annular gap 16 embodied between the upper portion 4*a* of the valve member and the bore 5; the flow resistance of the fuel through the throttling conduit or gap 15 is less than that of the annular gap 16. The control chamber 10 is embodied in FIG. 2 as radial widening of the upper portion of the bore 5, so that the volume of the control chamber 10 decreases in the closing motion of the valve member 4 when the control piston 11 plunges into it.

The mode of operation of the first exemplary embodiment of the fuel injection valve of FIG. 1 is as follows: Through a high-pressure fuel pump, via a fuel inlet line, fuel is introduced at high pressure into the inlet conduit 2. As a result, the fuel pressure also increases in the pressure chamber 3 and the annular conduit chamber 18. Because of the pressure face 9 disposed in the region of the pressure chamber 13, there is a resultant force acting on the valve member 4, oriented in the axial direction away from the combustion chamber, that counteracts the closing force of the spring 21. If this resultant force exceeds the closing force of the spring 21, then the valve member 4 moves axially away from the combustion chamber, and the valve sealing face 6 lifts from the valve seat 7. As a result, the injection opening 8 is made to communicate with the pressure chamber 3 via the blind bore 19 and the annular conduit 18, and fuel is injected into the combustion chamber.

At the onset of the opening stroke motion of the valve member 4, the control edge 14 overlaps the damping edge 13, and the control chamber 10 communicates with the oil leakage chamber 20 via the throttle gap 15. In the course of the opening stroke motion, the throttling edge 13 overtakes the control edge 14 and moves past it, until the valve member 4 with its stop shoulder 24 contacts the stroke stop 25. Because of the high fuel pressure in the pressure chamber 3, some of the fuel is also expelled through the annular gap 16 into the control chamber 10.

The closing motion of the valve member 4 is initiated when the fuel pressure in the inlet conduit 2 and thus also in the pressure chamber 3 drops. As soon as the resultant force on the pressure face 9 becomes less than the closing force of the spring 21, the valve member 4 is accelerated in the direction of the valve seat 7. When the pressure face 12 plunges into the control chamber 10, the fuel located in that chamber is positively displaced and expelled out of the control chamber 10 into the oil leakage chamber 20. As long as the damping edge 13 has not yet reached the control edge 14, this takes place with a comparatively slight flow resistance of the fuel, so that the pressure in the control chamber 10 is largely equal to that in the oil leakage chamber 20. As soon as the damping edge 13 reaches the control edge 14, the control chamber 10 is closed toward the oil leakage chamber 20, except for the throttle gap 15. The fuel pressure in the control chamber 10 thereupon rises and is decreased only slowly by the outflow of the fuel via the throttle gap 15. Because of the increased fuel pressure in the control chamber 10, a force on the pressure face 12 and thus on the valve member 4 results which force is counter to the closing force of the spring 21. The motion of the valve member 4 in the direction of the valve seat 7 is slowed down as a result; the valve sealing face 6 does not sit down as hard on the valve seat 7, and the high-frequency oscillations in the injection pressure and of the valve member 4 that occur upon impact are damped. A marked calming of the pressure course occurs at the fuel injection valve, and because of the softer seating of the valve member 4 on the valve seat 7, the maximum forces on the valve member 4 are reduced sharply, which in turn contributes to reduced engine noise. The wear of the valve member 4 caused by the valve seat 7 and of the valve sealing face 6 is reduced markedly as a result, and thus the service life of the fuel injection valve is prolonged.

Figure 3:
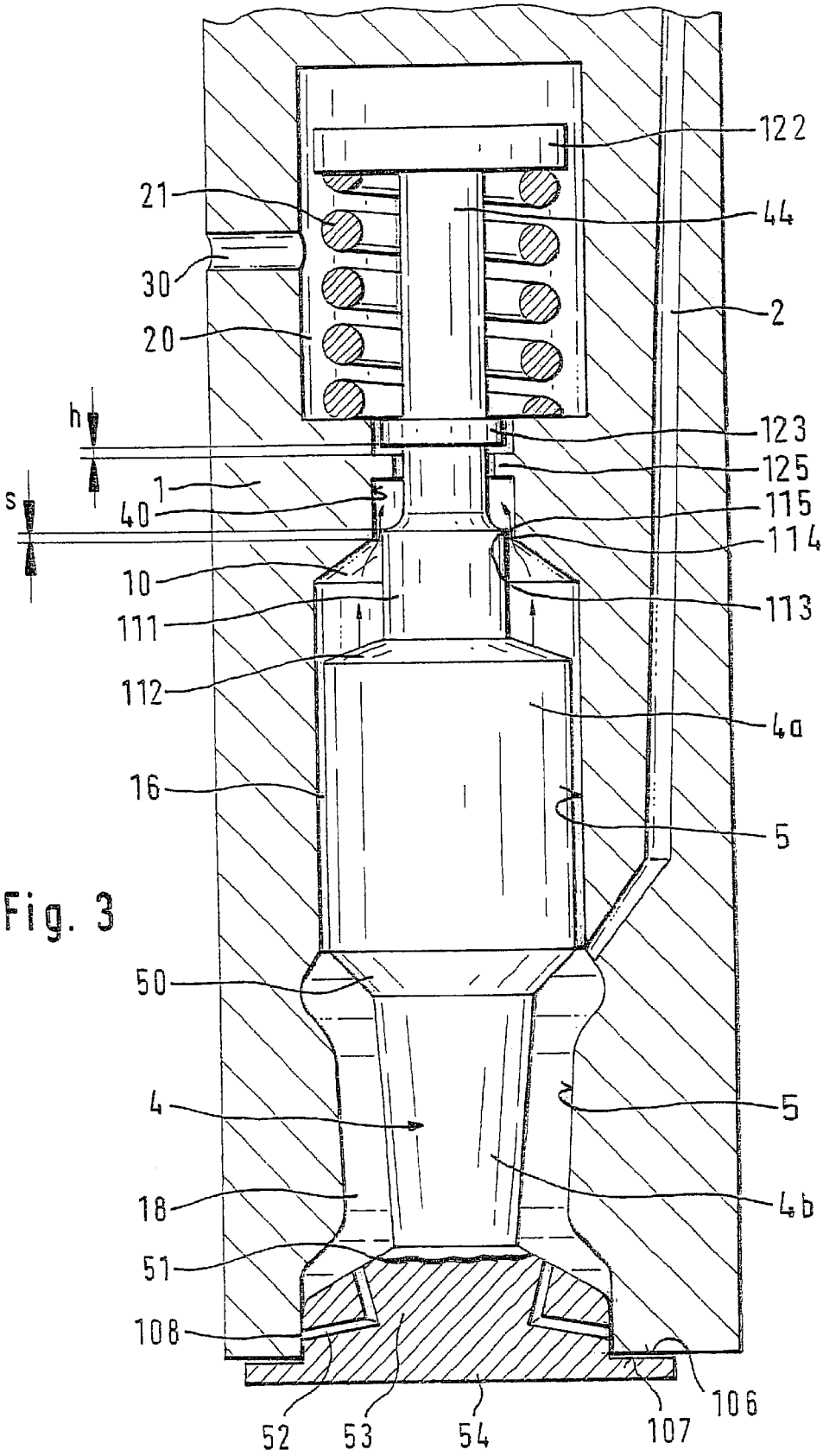
FIG. 3 is a longitudinal section through the second exemplary embodiment of an outward-opening fuel injection valve; and, FIGS. 4*a* and 4*b* show two features of the fuel outflow system with a pressure holding valve.

In FIG. 3, as a second exemplary embodiment, a longitudinal section through an outward-opening fuel injection valve is shown. The valve member 4 is again subdivided into an upper portion 4*a*, guided in the bore 5, and a lower portion 4*b*, which protrudes freely into the bore 5. The lower portion 4*b* of the valve member 4 is embodied with a smaller diameter than the upper portion 4*a*, so that an upper pressure face 50 is formed at the transition between the two portions 4*a*, 4*b*. A closing head 53 is disposed on the lower end of the valve member 4, and in this closing head at least one injection conduit 52 with an injection opening 108 is formed. The closing head 53 is embodied with a larger diameter than the upper portion 4*a*, so that a lower pressure face 51 is formed on the side of the closing head 53 remote from the combustion chamber. On the end toward the combustion chamber, the closing head 53 has a closing plate 54, whose annular end face toward the valve body 1 is embodied as a valve sealing face 106. The end face of the valve body 1 toward the combustion chamber is embodied as a valve seat 107 and cooperates with the valve sealing face 106. In the closed state of the valve member 4, the opening of the injection conduit 52 is closed by the valve body 1, and the valve sealing face 106 and the valve seat 107 assure secure sealing off of the injection opening 108 from the combustion chamber.

The bore 5 is adjoined, on the end of the valve member 4 remote from the combustion chamber, by a control bore 40, which is adjoined in turn by an oil leakage chamber 20. On the end toward the combustion chamber, the valve member 4 changes over into a control piston 111, which is embodied with a smaller diameter than the guided portion 4*a* of the valve member 4. As a result, a pressure face 112 is formed at the transition from the valve member 4 to the control piston 111, and the tapered embodiment of the control piston 111 forms a control chamber 10 between the control piston and the bore 5. The control piston 111 is adjoined by a spring tappet 44, which protrudes into the inside of the oil leakage chamber 20, and the spring tappet is adjoined by a valve plate 122. The spring tappet 44 is embodied with a smaller diameter than the control piston 111. In the control bore 40, a stroke stop 125 embodied as an annular shoulder is formed, which cooperates with a stop ring 123 shaped like an annular collar and disposed on the spring pin. The axial spacing of the lower face of the stop ring 123 and the upper face of the stroke stop 125 determines the opening stroke h of the valve member 4. A spring 21, preferably embodied as a helical compression spring, is disposed between the spring plate 122 and the end of the oil leakage chamber 20 toward the combustion chamber. This spring braces the spring plate 122 away from the combustion chamber, so that via the spring tappet 44 and the control piston 111, the valve member 4 is pressed with its valve sealing face 106 against the valve seat 107.

On the end remote from the combustion chamber of the jacket face of the control piston 111, a damping edge 113 is formed, which cooperates with a control edge 114 formed by the transition from the control bore 40 to the bore 5. In the closed state of the fuel injection valve, the control piston 111 plunges with the overlap s into the control bore 40. Since the control piston 111 has a diameter that is only slightly smaller than that of the control bore 40, a throttle gap 115 is formed between the control piston 111 and the control bore 40, and by way of the throttle gap, the control chamber 10 communicates with the oil leakage chamber 20. The overlap s of the edges 113 and 114 is less than the opening stroke h of the valve member 4, so that when the fuel injection valve is fully open, the control piston 111 emerges from the control bore 40.

The outward-opening fuel injection valve shown in FIG. 3 has the following mode of operation: The fuel introduced into the annular conduit 18 through the inlet conduit 2 acts upon both the upper pressure face 50 and the lower pressure face 51. Since the lower pressure face 51 has a larger surface area operative in the axial direction, the force on the valve member 4 toward the combustion chamber predominates. If the fuel pressure is equal to an opening pressure, then the resultant force exceeds the closing force of the spring 21. The valve sealing face 106 moves away from the valve seat 107, and the injection opening 108 emerges from the bore 5, until the stop ring 123 rests on the stroke stop 125. In the open position of the valve member 4, the control piston 111 is located outside the control bore 40. By means of a pressure drop in the annular conduit 18 to below the opening pressure, the valve member 4 is accelerated in the closing direction by the spring 21. As a result, the pressure face 112 moves into the control chamber 10, and fuel is thus expelled into the oil leakage chamber 20 via the control bore 40. Initially, this occurs with only a slight flow resistance; not until the damping edge 113 reaches the control edge 114 does the passage into the control bore 40 narrow down to the throttle gap 115. The pressure in the control chamber 10 rises, and by the resultant force on the pressure face 112, this causes a braked motion of the valve member 4 and thus a damped seating of the valve sealing face 106 on the valve seat 107.

Figure 4A:
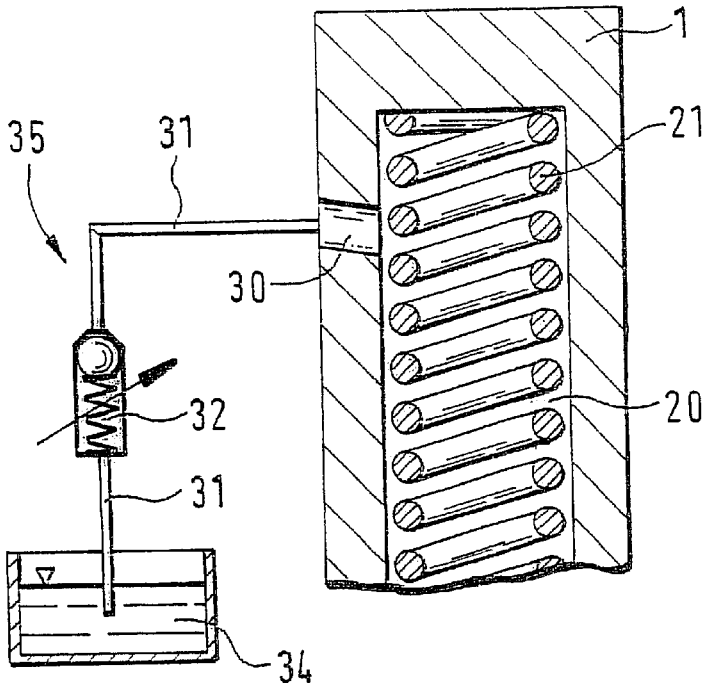
Figure 4B:
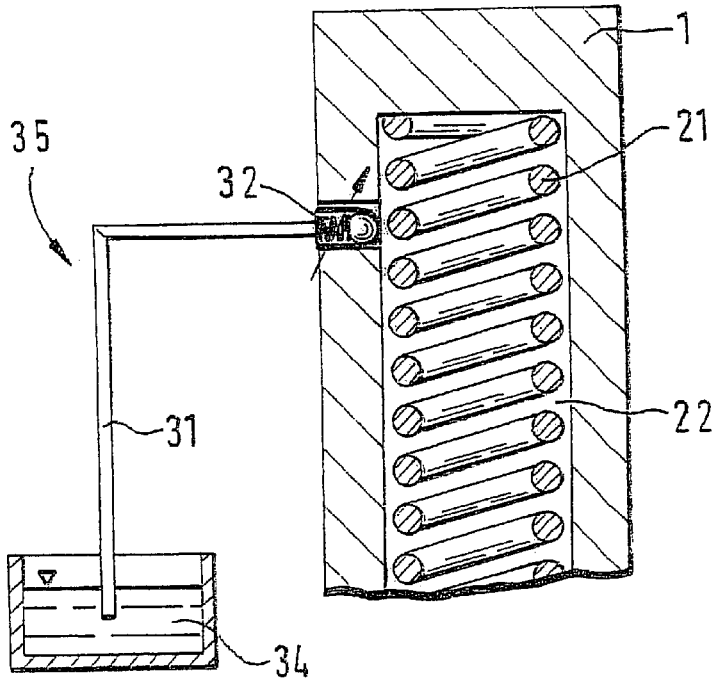

In FIG. 4*a*, one exemplary embodiment of the outflow system 35 of the fuel from the oil leakage chamber 20 is shown schematically. In the course of the outflow line 31, a pressure holding valve 32 is provided, which opens in the outflow direction toward the fuel tank 34 only at a certain pressure in the outflow line 31. As a result, a certain holding pressure is maintained in the outflow line between the fuel injection valve and the pressure holding valve 32 and thus in the oil leakage chamber 20 as well. In FIG. 4*b*, an alternative disposition of the pressure holding valve 32 is shown, which is disposed here in the outflow conduit 30 of the valve body 1. In this arrangement, it is unnecessary for assembly purposes to adapt the existing outflow system 35 to the altered fuel injection valve. The holding pressure of the fuel injection valve in both embodiments amounts to approximately 0.15 to 1.0 MPa. By means of the holding pressure in the oil leakage chamber 20, the outflow of the fuel from the control chamber 10 into the oil leakage chamber 20 during the closing motion of the valve member 4 is varied, since the outflow rate depends not only on the cross section of the throttle gap 15 but also on the pressure difference between the oil leakage chamber 20 and the control chamber 10.

It can also be provided that the holding pressure is regulatable at the pressure holding valve 32. This makes it possible to control the holding pressure as a function of the engine operating state and thus to adapt it in a purposeful way to various requirements.

The foregoing relates to preferred exemplary embodiments of the invention, it being understood that other variants and embodiments thereof are possible within the spirit and scope of the invention, the latter being defined by the claims.

We claim:

1. In a fuel injection valve for internal combustion engines, having a bore (5) embodied in the valve body (1), in which bore a pistonlike valve member (4) is disposed that is axially movable counter to the closing force of a spring (21) and that on its end toward the combustion chamber controls at least one injection opening (8) and that has a portion **(4*b*) toward the combustion chamber, which portion is disposed in an annular conduit (3, 18) filled with fuel at high pressure, and on which portion (4*b*) of the valve member (4) a pressure face (9) is embodied, and the pressure of the fuel acts on the pressure face (9) counter to the closing force of the spring (21), wherein the valve member (4) has a second pressure face (12, 122), by which a control chamber (10) surrounding the valve member (4) can be defined, so that upon the closing motion of the valve member (4) the volume of the control chamber (10) can be decreased, and the control chamber (10) is in constant communication, via a throttle gap (16), with the annular conduit (3, 18) and a further communication with an oil leakage chamber (20), which beyond a certain stroke of the closing motion of the valve member (4) is throttled via an annular gap (15, 115) which is formed between a control bore (40), disposed between the control chamber (10) and the oil leakage chamber (20), and a control piston (11, 111) of the valve member (4), the control piston plunging into the control bore (40)** upon closure.

2. The fuel injection valve of claim 1, wherein the flow direction of the fuel from the control chamber (10) is oriented substantially counter to the closing direction of the valve member (4).

3. The fuel injection valve of claim 1, wherein the flow direction of the fuel from the control chamber (10) is oriented substantially in the closing direction of the valve member (4).

4. The fuel injection valve of claim 2, wherein the valve member (4) has an opening stroke motion oriented away from the combustion chamber.

5. The fuel injection valve of claim 4, wherein the control chamber (10) is disposed between the portion **(4*b*) of the valve member (4) and the control piston (11)**.

6. The fuel injection valve of claim 5, wherein the piston (11) has a jacket face on the end of the piston (11) which is toward the combustion chamber, and has a damping edge (13), which cooperates with a control edge (14) embodied on the end of the control bore (40) remote from the combustion chamber.

7. The fuel injection valve of claim 6, wherein the damping edge (13), when the fuel injection valve is closed, has an overlap (s) with the control edge (14) that amounts to from 10–50% of the total opening stroke (h) of the valve member (4).

8. The fuel injection valve of claim 3, wherein the valve member (4) has an opening stroke motion oriented toward the combustion chamber.

9. The fuel injection valve of claim 8, wherein the control piston (111) has a jacket face on which, remote from the combustion chamber, a damping edge (113) is formed, which cooperates with a control edge (114) embodied on the end of the control bore (40) toward the combustion chamber.

10. The fuel injection valve of claim 9, wherein the damping edge (113), when the fuel injection valve is closed, has an overlap (s) with the control edge (114) that amounts to from 10–50% of the total opening stroke (h) of the valve member (4).

11. The fuel injection valve of claim 1, wherein the oil leakage chamber (20) has an outflow bore (30), which communicates with an outflow system (35) that discharges into a fuel tank (34).

12. The fuel injection valve of claim 11, wherein a pressure holding valve (32) is disposed in the outflow bore (30) and maintains a holding pressure in the outflow system (35).

13. The fuel injection valve of claim 12, wherein the pressure holding valve (32) is disposed in an outflow line (31) of the outflow system (35).

14. The fuel injection valve of claim 11, wherein the holding pressure is adjustable by the pressure holding valve (32).

15. The fuel injection valve of claim 12, wherein the holding pressure amounts to from 0.15 to 1.0 MPa.

16. The fuel injection valve of claim 1, wherein at least one further throttle connection is embodied between the control chamber (10) and the oil leakage chamber (20).

17. The fuel injection valve of claim 16, wherein the further throttle connection is embodied as a conduit embodied in the valve member (4).

18. The fuel injection valve of claim 16, wherein the further throttle connection is embodied as a conduit embodied in the valve body (1).

19. The fuel injection valve of claim 4, wherein the oil leakage chamber (20) has an outflow bore (30), which communicates with an outflow system (35) that discharges into a fuel tank (34).

20. The fuel injection valve of claim 6, wherein the oil leakage chamber (20) has an outflow bore (30), which communicates with an outflow system (35) that discharges into a fuel tank (34).

21. The fuel injection valve of claim 9, wherein the oil leakage chamber (20) has an outflow bore (30), which communicates with an outflow system (35) that discharges into a fuel tank (34).

22. The fuel injection valve of claim 10, wherein the oil leakage chamber (20) has an outflow bore (30), which communicates with an outflow system (35) that discharges into a fuel tank (34).

23. The fuel injection valve of claim 20, wherein a pressure holding valve (32) is disposed in the outflow bore (30).

24. The fuel injection valve of claim 22, wherein a pressure holding valve (32) is disposed in the outflow bore (30).

25. The fuel injection valve of claim 22, wherein the pressure holding valve (32) is disposed in an outflow line (31) of the outflow system (35).

26. The fuel injection valve of claim 13, wherein the holding pressure is adjustable by the pressure holding valve (32).

27. The fuel injection valve of claim 13, wherein the holding pressure amounts to from 0.15 to 1.0 Mpa.

28. The fuel injection valve of claim 14, wherein the holding pressure amounts to from 0.15 to 1.0 Mpa.

29. The fuel injection valve of claim 2, wherein at least one further throttle connection is embodied between the control chamber (10) and the oil leakage chamber (20).

30. The fuel injection valve of claim 4, wherein at least one further throttle connection is embodied between the control chamber (10) and the oil leakage chamber (20).

* * * * *

UNITED STATES PATENT AND TRADEMARK OFFICE

CERTIFICATE OF CORRECTION

PATENT NO. : 6,712,296 B1
DATED : March 30, 2004
INVENTOR(S) : Jaroslaw Hlousek et al.

It is certified that error appears in the above-identified patent and that said Letters Patent is hereby corrected as shown below:

Title page,
Item [56], References Cited, FOREIGN PATENT DOCUMENTS, insert item
-- [56] FOREIGN PATENT DOCUMENTS

| | | |
|---|---|---|
| DE | 199 40 558 A | 3/2000 |
| DE | 44 21 714 A | 1/1996 |
| DE | 39 00 763 A | 7/1990 -- |

Signed and Sealed this

Twenty-seventh Day of July, 2004

JON W. DUDAS
*Acting Director of the United States Patent and Trademark Office*